US007472652B1

(12) United States Patent
Scheid

(10) Patent No.: US 7,472,652 B1
(45) Date of Patent: Jan. 6, 2009

(54) DEMOLITION CHARGE HAVING MULTI-PRIMED INITIATION SYSTEM

(75) Inventor: Eric Scheid, Bloomington, IN (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/506,270

(22) Filed: Aug. 14, 2006

(51) Int. Cl.
*F42B 3/00* (2006.01)

(52) U.S. Cl. ..... 102/331; 102/314; 102/322

(58) Field of Classification Search ..... 102/331, 102/314, 317, 320, 322, 301, 332; 86/50; 89/1.14
See application file for complete search history.

(56) References Cited

U.S. PATENT DOCUMENTS 2,697,399 A * 12/1954 McAdams ..... 102/317
2,706,949 A * 4/1955 Kessenich ..... 102/306
4,957,027 A * 9/1990 Cherry ..... 89/1.14
7,000,545 B2 * 2/2006 Sansolo ..... 102/331
7,337,703 B2 * 3/2008 Sansolo ..... 89/1.14

* cited by examiner

*Primary Examiner*—James S Bergin
(74) *Attorney, Agent, or Firm*—Christopher A. Monsey

(57) ABSTRACT

A demolition charge system has a multi-primed initiation system with a rigid container having interconnected thin end walls, side walls, a base and a lid. The lid continuously fits onto the end and side walls to cover and contain an internal chamber. Each of the ends walls has a threaded opening longitudinally aligned with each other. An elongated thin-walled tube longitudinally extends through the internal chamber and has threaded ends engaging inner portions of the threaded openings to securely hold the tube in the container. At least one demolition initiator is capable of longitudinally extending in the tube and a main charge in the internal chamber is positionable in abutting contact along the tube to assure demolition. Magnets assure magnetic securing of the demolition system on a ferrous target.

20 Claims, 2 Drawing Sheets

DEMOLITION CHARGE HAVING MULTI-PRIMED INITIATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to demolition charges and more particularly to demolition charges capable of being initiated by a variety of standard military initiation systems or devices.

(2) Description of the Prior Art

Demolition packages containing explosives have long been used in the field to remove obstacles and accomplish a variety of other military purposes. Many of these demolition packages are hastily put together expedients; made under stressful conditions and, consequently, the packages may have sensitive components in the demolition train that detonate inadvertently or the packages simply may not have enough or the right kind of explosives to do what is needed. Consequently, the traditional bag-like "satchel charge" was developed to fill this need. The bag-like satchel charges are primarily canvas backpacks containing blocks of explosive linked by detonating cord. These charges are bulky (20 lbs) and are not easily primed or employed without some preparation by the user. The charges also do not have a multi-primed initiation system to assure reliable initiation. Additionally, because these charges can contain their own detonating cord and sensitive boosters; the charges are susceptible to accidental initiation. The traditional satchel charges can only be placed directly on or near a target and are not capable of being mounted by magnets, on a tripod or with other support apparatuses.

Thus, a continuing need exists for a military demolition charge having a rigid hollow case capable of being filled with a variety of explosives. The case should have and having ports, tubes and other receptacles containing magnets and/or for receiving a number of quickly installed blasting caps, detonators and a detonating cord to create a multi-primed initiation system for reliable and complete initiation.

SUMMARY OF THE INVENTION

Accordingly, it is a general purpose and primary object of the present invention to provide a military demolition charge capable of being reliably initiated by a variety of initiation systems or devices.

It is still further object of the present invention to provide a more reliable demolition charge capable of being loaded with a variety of explosives and initiated by blasting caps, detonators and/or detonating cords.

It is still further object of the present invention to provide a quickly deployable demolition charge having magnets and threaded receptacles for engaging different structures.

It is a still further object of the present invention to provide a safe demolition charge capable of being initiated by any of a plurality of blasting caps, detonators, and/or detonating cords installed just prior to a planned demolition.

It is still further object of the present invention is to provide a plurality of quickly deployable demolition charges primed with a common detonating cord strung through them.

In order to attain the objects of the present invention, a demolition charge system is provided in which the system has a multi-primed initiation system for improved reliability and safety.

A rigid container is provided having interconnected rigid thin end walls, side walls, a base wall and a lid. The lid continuously fits onto the end and side walls to cover and contain an internal chamber. Each of the ends walls has a threaded opening longitudinally aligned with each other. An elongate hollow thin-walled plastic tube longitudinally extends through the internal chamber and has threaded ends engaging inner portions of the threaded openings to securely hold the tube in the container. At least one demolition initiator longitudinally would extend in the tube. In an alternate configuration and preferably used for smaller containers, two elongate hollow thin-walled tubes extending from corners of the container and integrating in the middle of the container may be used to contain the demolition initiators.

A main charge in the internal chamber is placed in close abutting intimate contact along the length of the tube(s) where the tube(s) extends through the chamber to assure demolition of the main charge. A continuous recessed strip portion having a continuous groove is provided to extend along a continuous rim of the end walls and the side walls.

A continuous lip portion along the outer edge of the lid is shaped with an inwardly extending continuous rim. The lip portion and the inwardly extending continuous rim of the lid are sized to be fitted onto the strip portion and a continuous groove of the side and end walls with sufficient force to compress and override the continuous strip portion and fit the continuous rim into the a continuous groove in a sealed interlocking engagement.

The threaded openings have outer portions adapted to engage correspondingly shaped structure of a support structure to more advantageously locate the main charge with respect to a target. Elongate tubular receptacles are equidistantly spaced apart around the periphery of the internal chamber. Each of the elongate tubular receptacles has an elongate cavity extending between inner surfaces of the base and the lid to contain a magnet disposed in each cavity.

BRIEF DESCRIPTION OF THE DRAWINGS

Further objects and advantages of the present invention will become readily apparent upon reference to the following description of the preferred embodiments and to the accompanying drawings, wherein corresponding reference characters indicate corresponding parts in the drawings and wherein.

DESCRIPTION OF THE PREFERRED EMBODIMENT

Figure 1:
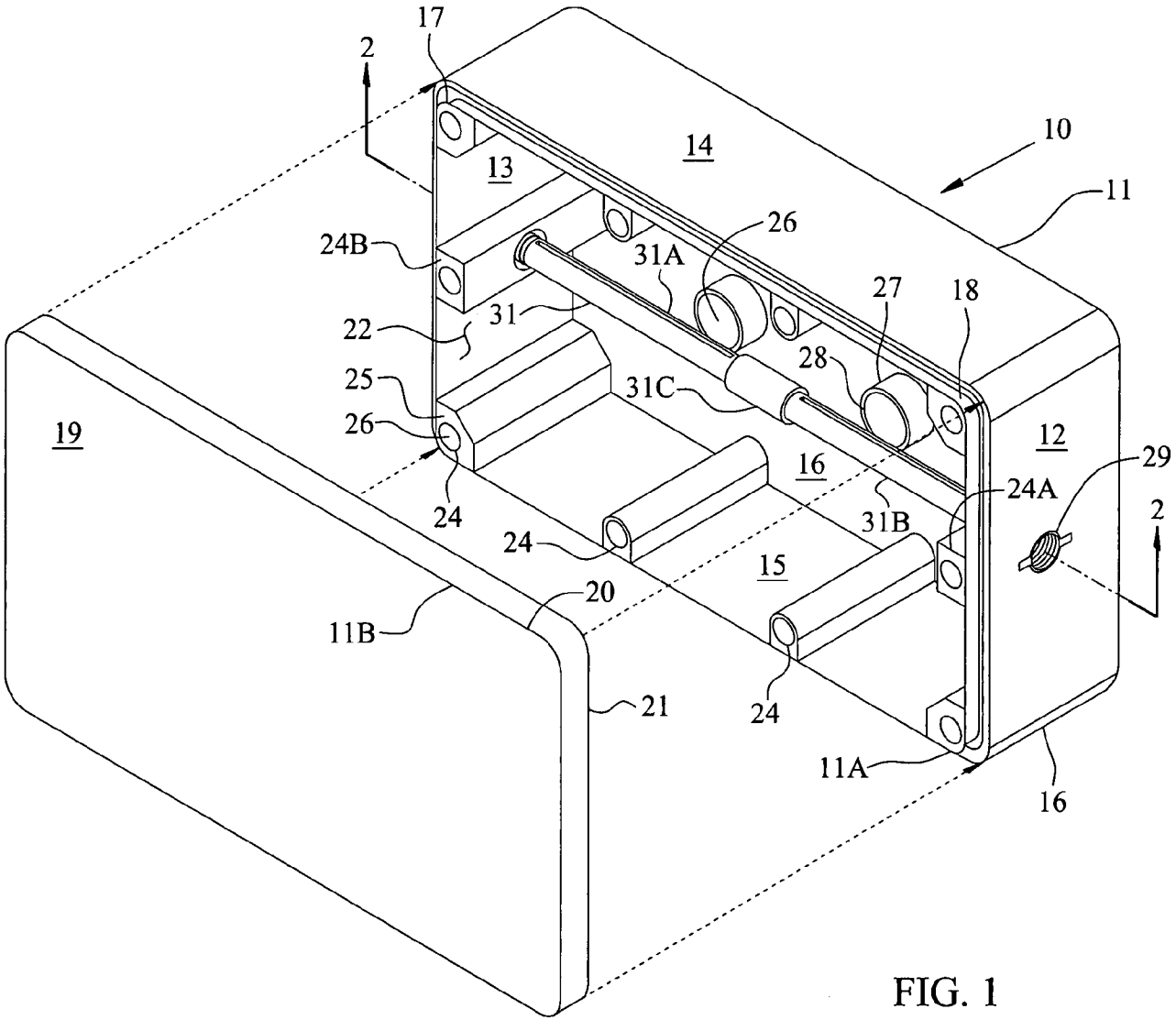
FIG. 1 depicts an isometric view of a rigid box-shaped charge container of the present invention forming an internal chamber for containing a volume of explosives and having a lid of the container removed to depict a number of receptacles for magnets inside of and along the periphery of the explosive-filled chamber and a thin-walled initiation tube longitudinally extending through the chamber.
Figure 2:
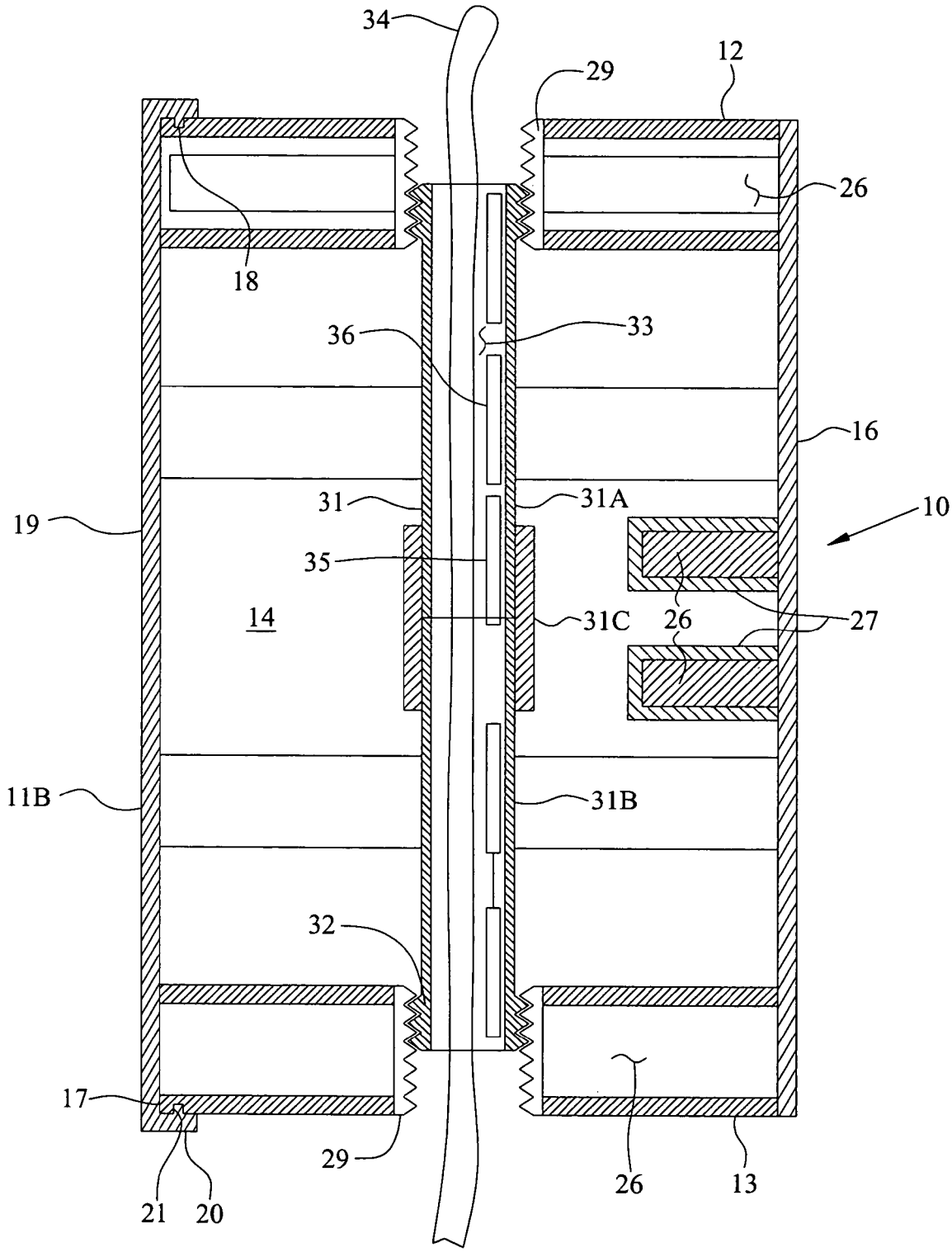
FIG. 2 depicts a cross-sectional view of the container and longitudinally extending thin-walled initiation tube taken generally along reference lines 2-2 of FIG. 1 with the lid of the container and the container shown assembled.

Referring now to FIG. 1 and FIG. 2, an improved demolition charge system 10 of the present invention has a box-like container 11 made from a plastic material or other costeffective material that creates a rigid structure suitable to house explosives, is relatively non-corrosive, and is preferably non-conductive to low magnitudes of electrical power and static electricity. Wood may be selected as well as most metals provided that they are properly treated to be sealed and resistant to the corrosive influences of the operating environment. The container 11 can be molded or extruded as an integral watertight rigid structure from the plastic material to have interconnected and relatively light-weight thin end walls 12 and 13, side walls 14 and 15, and base wall or base 16 of sufficient toughness and crush resistance to be serviceable for field operations.

A continuous recessed strip portion 17 having a continuous groove 18 extends along a continuous rim 11A of the end walls 12 and 13 and the side walls 14 and 15.

A flat top wall, or removable lid 19 of the container 11 has a continuous lip portion 20 along an outer edge 11B that is shaped with an inwardly extending continuous rim 21. The lip portion 20 and the rim 21 are sized to be fitted onto the strip portion 17 and the continuous groove 18 with sufficient force to compress and override the strip portion 17 and to fit the continuous rim 21 into the groove 18 in a sealed and interlocking engagement. In other words, the rim 21 has sufficient resiliency and exerts sufficient inward bias to accommodate and ride-over the lip portion 20 and then snap into the groove 18 as the lid 19 is fitted onto the side walls 12, 13 and the end walls 14, 15. The container 11 having the lid 19 in place, on the side walls 12, 13 and the end walls 14, 15 and the base 16, covers and forms an internal chamber 22 that may contain, and preferable be filled with an explosive main charge (not shown).

Since different explosives create different explosive effects, the constituency of main charge can be suited to the task to be performed and the explosives available. Mixes of different explosives might be desirable or a smaller main charge in the chamber 22 may be needed. In this case, the required amount of the selected explosives can be measured out and placed in the chamber 22, or if more is needed for a task, additional ones of the demolition charge system 10 can be stacked and simultaneously detonated. In either case, reliable demolition is assured because of the initiation of the present invention to be discussed further on below.

The container 11 of the demolition charge system 10 has a number of elongate tubular receptacles 24 equi-distantly spaced apart around the periphery of the chamber 22. The receptacles 24 can be integrally formed with the end walls 12 and 13, the side walls 14 and 15, and the base 16. The receptacles 24 each have an elongate hollow cylindrical-shaped cavity 25 that extends between the inside surfaces of the base 16 and the lid when the lid 19 is secured on the recessed strip portion 17.

A magnet 26 is placed in each elongated cavity 25. Shorter receptacles 27 having magnets 26 in their shorter cylindrical cavities 28 can be located on the base 16 along the centerline to further assure magnetic securing of the demolition charge system 10 on an iron-based surface. All of the magnets 26 can magnetically hold the demolition charge system 10 on and against a steel, iron, or other ferrous target. The magnets 26 also allow for the quick attachment of a fragmentation plate accessory (not shown) whether or not the magnets engage or not engage a target.

Optionally, one or more of the receptacles 24 and 27 can have the magnets 26 removed. More explosives including auxiliary blasting caps or other detonators can be substituted in the cavities 25 and 28 to further assure demolition of a main charge. This option is more attractive when there is no need to anchor the demolition charge system 10 on ferrous targets.

The end walls 12 and 13 are provided with threaded fittings 29 having openings or apertures longitudinally aligned with each other and also extending through adjacent receptacles 24A and 24B. An elongate, hollow, thin-walled plastic initiation tube 31 extends through the chamber 22 approximate to the longitudinal centerline of the container 11 and through the center of the chamber 22 and where the main charge would be positioned. The initiation tube 31 has threaded ends engaging inner portions of the threaded fittings 29 to securely hold the tube in the container 11. The initiation tube 31 may be a single piece, but optionally the tube may have aligned portions 31A and 31B joined by a coupling sleeve 31C. The aligned portions 31A and 31B and coupling sleeve 31C may be useful to aid mounting of tube 31 in the container 11. In an alternate configuration and preferably used for smaller containers, two elongate hollow thin-walled initiation tubes 31 extending from the corners of the container and integrating in the middle of the container may be used to contain demolition initiators. The configuration of the initiation tubes 31 is similar to a cross when viewed from the top of the box and centralized within the volume of the container 11.

Irrespective of the exact configuration of the initiation tube 31, the tube has a relatively large longitudinally extending internal duct 33 to receive a number of the demolition initiators for priming of the main charge. The demolition initiators can be individual ones of or can include combinations of: a detonating cord 34 of fifty grains per foot size, and/or 2.) blasting caps 35 that may be connected to appropriate cap-initiating means such as, electrically conductive wires or a standard igniting fuse and/or 3.) other standard military initiation devices 36 such as time-actuated, chemically-actuated, and/or remote radio signal-actuated detonators. These multi-primed combinations of demolition means increase the safety of operation by introducing redundancy and can create higher or more intense shock waves to further guarantee reliable demolition of the main charge.

The thin-walled initiation tube(s) 31 can be sized to have one or more of the detonating cords 34, blasting caps 35, and the other standard detonators 36 quickly installed by the user to reliably initiate the main charge in the chamber 22. The main charge would be positioned in the chamber 22 is in close-abutting and intimate contact along the length of the initiation tube 31 where the tube extends through the chamber in order to assure demolition of the main charge. Reliable initiation is further enhanced because of the design of the initiation tube 31 extending through a main charge in the chamber 22 and the use, if necessary, of a thin-walled cylinder booster charge. The booster charge would be wrapped around the hollow initiation tube(s) 31.

Use of a mounting tripod (not shown) or other mounting support apparatus for raising the demolition charge system 10 above the ground and specifically locating the system in close proximity next to a building or other above-ground target might be required to increase the effectiveness of the demolition charge system. The demolition charge system 10 of the present invention can be appropriately located for such applications since outer portions of the threaded fittings 29 that are not engaged by threaded ends 32 of the hollow initiation tube 31 can be used to receive a projection or correspondingly threaded mounting stud (not shown) of a mounting tripod or other support apparatus. In other words, the outer portions of the threaded fittings 29 are adapted to engage a correspondingly shaped structure of different support structures to more advantageously locate the main charge with respect to an intended target. Accordingly, the demolition charge system 10 of the invention can be used with a greater degree of effectiveness.

The demolition charge system 10 of the present invention is a needed improvement over the explosive expedients of the prior art. The amount and constituency of the main charge can be quickly tailored in the field if need be, or an appropriate number of demolition charge systems 10 can be quickly made beforehand for a demolition task. Since a particular size for the demolition charge system 10 can be "standardized" (at say about ten pounds, for example), a considerable inventory can be pre-made and personnel can be trained in their proper use. The container 11 can be made in a variety of different shapes instead of the box-like configuration referred to above so long as it encloses a chamber containing the correct amount of explosives.

The demolition charge system 10 can be primed with one or more of the detonating cords 34 so that the required number of demolition charge systems can be "strung" on the same line of the detonating cord and initiated at the same time. Without the longitudinally extending thin-walled initiation tube 31 of each demolition charge system 10 containing the common "strung-through" detonating cord 34, each charge would otherwise need an individual detonator. Since detonators and handling detonators are known to be the most dangerous parts of a demolition system, the claimed demolition charge systems 10 having a common detonating cord 34 reduce or eliminate the need for multiple separate detonators and decrease the risks and hazards to users.

Since the demolition charge system 10 can be loaded with a variety of explosives, the main charge can be tailored for the job and use the materials at hand. The selected main charge may contain a booster that is less sensitive (safer) than previous charges, yet the main charge is sensitive enough to be initiated via the detonating cord 34 coextending in the longitudinally extending initiation tube 31.

As a further safety feature of the demolition charge system 10 of the invention, the system need not be shipped or stored with the detonating cord 34 built in order to make the system safer and less likely to detonate accidentally. Instead, the detonating cord 34 can be quickly inserted through the duct 33 of the initiator tube 31 of each demolition charge systems just prior to demolition in the field.

Threaded openings 29 create a pair of ports on opposite ends of demolition charge system 10. Accordingly, each demolition charge system 10 can be simultaneously mated to one or more detonators (detonating cord, blasting caps etc.) and onto a tripod or other mating projection on another support apparatus. The gives the user many options in the way the charge is used and makes using the charge easier than conventional designs. Optionally, cables could be strung through openings to provide for support and/or be used to slide or pull appropriate demolition initiators into the initiation tube 31 for immediate or later demolition.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A demolition charge system having a multi-primed initiation system comprising:

a container having interconnected end walls, side walls, base wall and a lid, said lid continuously fitting onto said end and side walls to cover and contain an internal chamber and each of said ends walls having a threaded aperture being longitudinally aligned with each other; and an elongated hollow tube longitudinally extending through said internal chamber, said tube having opposing open threaded ends engaging inner portions of said threaded apertures to securely hold said tube in said container;

wherein at least one demolition initiator is capable of longitudinally extending through both said opposing open threaded ends of said tube and wherein a main charge is capable of positioning in said internal chamber such that said tube extending through the main charge in said chamber and the main charge is positionable in abutting contact along the length of said tube to assure demolition of the main charge upon use of the at least one demolition initiator.

2. The system of claim 1 wherein said tube extends along a longitudinal centerline of said container and through a center of said internal chamber.

3. The system of claim 2 further comprising:

a continuous recessed strip portion having a continuous groove extending along a continuous rim of said end walls and said side walls; and a continuous lip portion along the outer edge of said lid shaped with an inwardly extending continuous rim.

4. The system of claim 3 wherein said lip portion and said inwardly extending continuous rim of said lid are sized to be fitted onto said strip portion and said continuous groove of said side and end walls with sufficient force to compress and override said continuous strip portion and fit said continuous rim into said continuous groove in a sealed interlocking engagement.

5. The system of claim 4 wherein said threaded apertures have portions adapted to engage a correspondingly shaped structure of a support apparatus to locate said system with respect to a target.

6. The system of claim 5 further comprising:

a first plurality of elongated tubular receptacles mounted on said side and end walls and equidistantly spaced apart around the periphery of said internal chamber, each of said first elongated tubular receptacles having an elongated cavity extending between inner surfaces of said base and said lid; and a magnet disposed in each of said elongate cavities.

7. The system of claim 6 further comprising:

a second plurality of tubular receptacles shorter in length than said first plurality of elongated tubular receptacles and located on said base along a centerline of said base, each of said second tubular receptacles having a cavity; and a magnet disposed in each of said cavities of said second tubular receptacles.

8. The system of claim 7 wherein said first elongated and said second shorter tubular receptacles can be integrally formed with said end walls, said side walls and said base.

9. The system of claim 8 wherein said magnets assure magnetic securing of said container of said system on a ferrous target.

10. A demolition charge system comprising:

a container having interconnected end walls, side walls, a base wall and a lid, said lid fitting onto said end walls and said side walls to cover an internal chamber defined between said end walls, said side walls, and said base wall;

an elongated hollow tube longitudinally extending through said internal chamber between opposing ends;

a pair of couplers, each of said couplers supported by one of said end walls and engaging one of said opposing ends of said tube such that said tube is supported within said internal chamber between said end walls and in spaced relation to said side walls and said lid;

at least one demolition initiator extending longitudinally within said tube; and a main charge positioned within said internal chamber such that said tube extends in proximity to said main charge for causing detonation of said main charge upon activation of said at least one demolition initiator.

11. The system of claim 10, wherein each of said end walls include an aperture longitudinally aligned with each other, and each of opposing ends of said tube are open and received within one of said apertures of said end walls such that said at least one demolition initiator is capable of extending through both said opposing ends of said tube.

12. The system of claim 10, wherein each of said couplers comprises a threaded aperture supported by one of said end walls, and said tube includes threaded ends engaging said threaded apertures to securely hold said tube within said container.

13. The system of claim 12 wherein said threaded apertures have portions adapted to engage a correspondingly shaped structure of a support apparatus to locate said system with respect to a target.

14. The system of claim 10 wherein said tube extends along a longitudinal centerline of said container and through a center of said internal chamber.

15. The system of claim 10 further comprising:

a continuous recessed strip portion having a continuous groove extending along a continuous rim of said end walls and said side walls; and a continuous lip portion along the outer edge of said lid shaped with an inwardly extending continuous rim.

16. The system of claim 10 further comprising:

a first plurality of elongated tubular receptacles mounted on said side and end walls and equidistantly spaced apart around the periphery of said internal chamber, each of said first elongated tubular receptacles having an elongated cavity extending between inner surfaces of said base and said lid; and a magnet disposed in each of said elongate cavities.

17. A demolition charge system comprising:

a container having opposing walls, a base coupled to said walls, and a lid, said lid fitting onto said walls to cover an internal chamber defined between said walls and said base; and an elongated hollow tube longitudinally extending through said internal chamber, said tube having opposing open ends supported by said opposing walls;

wherein said elongated hollow tube is adapted to receive a detonating cord extending longitudinally through both said opposing open ends of said tube, and said internal chamber of said container is adapted to received a main charge such that said tube extends in proximity to said main charge for causing detonation of said main charge upon activation of said detonating cord.

18. The system of claim 17 wherein said container includes interconnected end walls, side walls, a base wall and a lid, said lid continuously fitting onto said end and side walls to cover and contain said internal chamber.

19. The system of claim 17, further comprising a pair of couplers, each of said couplers supported by one of said opposing walls and engaging one of said opposing open ends of said tube such that said tube is supported within said internal chamber between said opposing walls.

20. The system of claim 19, wherein each of said couplers comprises a threaded aperture supported by one of said opposing walls, and said tube includes threaded ends engaging said threaded apertures to securely hold said tube within said container.

* * * * *